US011118880B2

(12) United States Patent
Arnold et al.

(10) Patent No.: US 11,118,880 B2
(45) Date of Patent: Sep. 14, 2021

(54) FRAGMENTATION WARHEAD FOR A MISSILE

(71) Applicant: TDW Gesellschaft für verteidigungstechnische Wirksysteme mbH, Schrobenhausen (DE)

(72) Inventors: Werner Arnold, Ingolstadt (DE); Christian Euba, Schrobenhausen (DE)

(73) Assignee: TDW Gesellschaft für Verteidigungstechnische Wirksysteme mbH, Schrobenhausen (DE)

( * ) Notice: Subject to any disclaimer, the term of this patent is extended or adjusted under 35 U.S.C. 154(b) by 0 days.

(21) Appl. No.: 17/069,490

(22) Filed: Oct. 13, 2020

(65) Prior Publication Data

US 2021/0108904 A1 Apr. 15, 2021

(30) Foreign Application Priority Data

Oct. 14, 2019 (DE) ..... 102019007104.2

(51) Int. Cl.
*F42B 12/32* (2006.01)

(52) U.S. Cl.
CPC ..... *F42B 12/32* (2013.01)

(58) Field of Classification Search
CPC ..... F42B 12/32; F42B 12/22; F42B 12/02; F42B 12/24

(Continued)

(56) References Cited

U.S. PATENT DOCUMENTS 2,972,949 A * 2/1961 MacLeod ..... F42C 15/42 102/401
3,646,888 A * 3/1972 Posson ..... F42B 30/10 102/496
3,714,897 A 2/1973 Parker (Continued)

FOREIGN PATENT DOCUMENTS

DE 4139372 C1 3/1995
DE 19917173 A1 10/2000
DE 19531287 B4 1/2007

OTHER PUBLICATIONS

German Search Report dated Jul. 24, 2020 issued in corresponding DE 102019007104.2 application (12 pages).

*Primary Examiner* — Joshua E Freeman
(74) *Attorney, Agent, or Firm* — Millen, White, Zelano & Branigan, P.C.; William F. Nixon

(57) ABSTRACT

A fragmentation warhead for a missile includes a warhead casing, an active charge arranged within the warhead casing, and a fragmentation filling arranged within the warhead casing in front of the active charge of the fragmentation warhead in an effective direction of the fragmentation warhead. When the active charge is ignited, fragments are hurled out of the fragmentation filling in the effective direction within a first outlet opening angle. The fragmentation warhead includes a fragmentation damping charge, which is arranged within the warhead casing laterally to the effective direction on the fragmentation filling, to exert a lateral damping pressure on the fragmentation filling upon ignition. The fragmentation warhead includes a fragmentation damping filling, which is arranged within the warhead casing laterally to the effective direction on the fragmentation filling such that the metal powder is released laterally from the fragmentation filling when the active charge is ignited.

14 Claims, 5 Drawing Sheets

(58) Field of Classification Search
USPC ..... 102/492
See application file for complete search history.

(56) References Cited

U.S. PATENT DOCUMENTS

| | | | | |
|---|---|---|---|---|
| 3,970,005 | A * | 7/1976 | Rothman | F42B 12/22 102/492 |
| 4,106,411 | A * | 8/1978 | Borcher | F42B 12/44 102/495 |
| 5,090,324 | A * | 2/1992 | Bocker | F42B 1/032 102/307 |
| 5,540,156 | A * | 7/1996 | Fong | F42B 12/22 102/306 |
| 5,544,589 | A * | 8/1996 | Held | F42B 12/204 102/475 |
| 7,658,150 | B2 * | 2/2010 | Ronn | F42B 1/02 102/476 |
| 7,971,535 | B1 | 7/2011 | Kim et al. | |
| 8,161,884 | B1 * | 4/2012 | Kokodis | F42B 12/24 102/493 |
| 8,661,982 | B2 * | 3/2014 | Rohr | F42B 12/24 102/499 |
| 9,109,865 | B2 * | 8/2015 | Haskins | F42B 12/207 |
| 9,243,876 | B1 * | 1/2016 | Botthof | F42B 12/205 |
| 9,638,500 | B1 * | 5/2017 | Blyskal | F42B 12/207 |
| 10,982,942 | B1 * | 4/2021 | Stowe | F42B 12/22 |
| 2004/0074413 | A1 | 4/2004 | Ronn et al. | |
| 2011/0146523 | A1 * | 6/2011 | Kim | F42B 12/22 102/494 |
| 2016/0025468 | A1 * | 1/2016 | Botthof | F42B 12/207 102/475 |
| 2017/0146326 | A1 * | 5/2017 | Arnold | F42B 12/22 |

* cited by examiner

FRAGMENTATION WARHEAD FOR A MISSILE

The present invention relates to a fragmentation warhead for a missile and to a missile having such a fragmentation warhead.

Combating ground targets from the air increasingly requires more flexibility in terms of its impact. For example, the United States Air Force has developed a switchable system called "Low Cost Autonomous Attack System" (LOCAAS) for combating armoured and unarmoured vehicles using drone systems. The system can autonomously distinguish between hard targets (tanks) and semi-hard targets (radar positions, trucks, etc.) and use two different modes of action, whereby a projectile (a so-called "explosively formed projectile") is used against hard targets and fragments are used against semi-hard targets. Different multiple ignitions allow the charge of the system to switch back and forth between these two modes of action, so that a high degree of flexibility is achieved.

For certain applications, more stringent requirements are placed on the flexibility of the active system. For example, a focused mode may be required, for example targeted destruction of an engine of a moving vehicle. In addition, however, depending on the situation, it may be necessary to disable not only the engine but the entire vehicle, i.e. to carry out a non-focused attack. There is thus a need for certain applications to vary an effective scope or an effective direction of an effective system as flexibly as possible. Here, environmental conditions, such as cross winds, may require very short-term directional corrections in order to guarantee a precise operation of the system.

DE 41 39 372 C1 describes a fragmentation warhead in which deformation charges are arranged around a fragmentation casing so as to extend in a longitudinal direction of the fragmentation warhead. The deformation charges are detonated in front of a main explosive charge in order to depress the fragmentation casing and thus achieve an increased hit density compared to rigid fragmentation casings.

A challenge with such and other fragmentation systems is to restrict the area to be created, i.e. the "footprint", to the actually required lateral target extension. Generally speaking, the problem is often to adhere to a specified, limited target area and, for example, to avoid or intercept, if possible, edge fragments having large lateral exit angles, so-called "stray" edge fragments. For example, warheads are sometimes designed with structural metal frames, retaining rings or other lateral reinforcements, for example made of a steel material, which are intended to prevent or deflect peripheral edge fragments. However, it must be ensured here that these reinforcements do not themselves produce secondary fragments having large exit angles/opening angles.

Against this background, the problem addressed by the present invention is that of finding solutions for fragmentation systems having improved accuracy.

According to the invention, this problem is solved by a fragmentation warhead having the features of claim 1, by a fragmentation warhead having the features of claim 5, and by a missile having the features of claim 14.

According to one embodiment of the invention, a fragmentation warhead for a missile is provided. The fragmentation warhead comprises: a warhead casing; an active charge, which is arranged within the warhead casing; a fragmentation filling, which is arranged within the warhead casing in front of the active charge of the fragmentation warhead in an effective direction of the fragmentation warhead and designed such that when the active charge is ignited, fragments are hurled out of the fragmentation filling in the effective direction within a first exit opening angle; and a fragmentation damping charge, which is arranged within the warhead casing laterally to the effective direction on the fragmentation filling and designed to exert a lateral damping pressure on the fragmentation filling upon ignition.

According to a further embodiment of the invention, a fragmentation warhead for a missile is provided. The fragmentation warhead comprises: a warhead casing; an active charge, which is arranged within the warhead casing; a fragmentation filling, which is arranged within the warhead casing in front of the active charge of the fragmentation warhead in an effective direction of the fragmentation warhead and designed such that when the active charge is ignited, fragments are hurled out of the fragmentation filling in the effective direction within a first exit opening angle; and a fragmentation damping filling, which has a metal powder and which is arranged within the warhead casing laterally to the effective direction on the fragmentation filling and designed such that the metal powder is released laterally from the fragmentation filling when the active charge is ignited.

According to a further embodiment of the invention, a missile having a fragmentation warhead according to the invention is provided.

One concept on which the present invention is based consists in restricting edge fragments having large exit angles as far as possible to completely by surrounding the fragmentation filling or charge either with an explosive charge or with a layer of metal powder. The explosive charge can for example be made of the same material as the primary active charge. Ignition of the explosive charge generates shock waves, which in turn build up lateral pressure, which prevents the fragments emerging from the fragmentation filling from expanding laterally. Alternatively, the metal powder of the fragmentation damping filling provides an "inert" solution. After the ignition of the active charge, (small) powder grains of the released metal powder lead, due to their large surface-to-volume ratio, to an exponential deceleration of possible edge fragments in the surrounding air. The powder filling can be "impedance-adjusted" (material impedance: density×sound/shock speed) in order to achieve an optimal limitation of the lateral acceleration of released edge fragments depending on the selected materials and geometries. A powder barrier of this kind is slowed down in the air to such an extent that there are no ballistic effects even in the close-up state.

As a result, the solutions according to the invention prevent fragments having large exit angles, so that undesirable accompanying damage (collateral damage) is excluded. A lethal fragment effective radius can be limited only to a laterally specified target size.

The fragmentation warhead according to the invention can be, for example, axially symmetrical with respect to the effective direction, for example cylindrically symmetrical. In this case, the fragmentation damping charge or the fragmentation damping filling lies radially outside the fragmentation filling in order to stop radially or obliquely emerging fragments and only allow fragments up to a certain first exit opening angle based on the effective direction. In principle, however, the solution according to the invention can also be applied to other active systems in which edge fragments can occur and at the same time a laterally limited effect must be maintained.

Advantageous embodiments and developments can be found in the further dependent claims and from the description with reference to the figures.

According to a development, the fragmentation damping charge can be formed in a ring around the fragmentation filling. The fragmentation damping charge can thus be formed as an explosive ring around the fragmentation filling, for example in an axially symmetrical warhead system.

According to a development, the fragmentation damping charge can completely cover the fragmentation filling laterally. This can thus ensure that no fragment can escape laterally from the fragmentation filling without first hitting the fragmentation damping charge or being slowed down by its pressure wave.

According to a development, the fragmentation warhead can furthermore comprise a safety and control device. The safety and control device can be designed to ignite the fragmentation damping charge in a time-synchronised manner with the active charge. The safety and control device can, for example, contain logic that regulates the ignition sequence (time delay logic).

According to a development, the fragmentation damping filling can be formed in a ring around the fragmentation filling. The fragmentation damping filling can thus be formed as a powder ring around the fragmentation filling, for example in an axially symmetrical warhead system.

According to a development, the fragmentation damping filling can completely cover the fragmentation filling laterally. This can thus ensure that no fragment can escape laterally from the fragmentation filling without first hitting the metal powder of the fragmentation damping filling and being slowed down thereby.

According to a development, the fragmentation damping filling can be divided into several filling containers. The filling containers can be arranged as a ring around the fragmentation filling. Alternatively, other embodiments are of course also conceivable.

According to a development, the filling containers can be designed as plastics tubes. For example, one or more plastics tubes can be filled with heavy metal powder and arranged around the fragmentation filling.

According to a development, the metal powder can comprise a heavy metal.

According to a development, the fragmentation warhead can furthermore comprise a deformation charge. The deformation charge is arranged in front of the fragmentation filling in the effective direction and designed to push the fragmentation filling in the direction of the active charge by ignition, so that the first exit opening angle of the fragmentation filling is reduced to a second exit opening angle.

This embodiment is based on the concept of an adjustable focus, which can be adjusted in the short term to the type of target aimed at. For this purpose, for example, a deformation charge layer can be detonated at a front end of the warhead in order to push a fragmentation arrangement located behind it into the interior of the warhead to a certain extent. For example, a cavity can be provided in the interior of the warhead for this purpose, which cavity can be hollow or filled with gas, liquid or a "soft" material such as foam or the like. For example, a polyurethane foam can be provided for filling such a cavity with a suitable density. The geometry of the front end of the warhead is deformed in such a way that when the main charge is ignited, the fragments emerge at a different angle and are hurled at the target. Before the deformation charge is ignited, the fragmentation layer can have a flat or convex shape, for example. After the deformation charge has detonated, this surface can be brought into an at least approximately concave shape due to the movement into the interior of the warhead. In this case, the opening angle of the fragments is reduced relative to a longitudinal axis (i.e. the effective direction) of the warhead.

This embodiment of the invention thus makes it possible to switch in a flexible manner between different focusing or modes of action of the active system. In an initial state, the active system is in a non-focused mode, which can be converted into a focused mode by detonating the deformation charge. For this purpose, the deformation charge can be ignited prior to the ignition of the actual main charge, i.e. the active charge. The operating characteristics or operating accuracy of the system can thus be set in a particularly flexible manner shortly before the actual main charge is ignited. Environmental influences can thus be counteracted in a targeted manner. In addition, the mode of action of the system can be adapted to the target, whereby collateral damage is minimised.

According to a development, the fragmentation filling can be designed for delivering preformed fragments and/or controlled fragments. For example, the fragmentation filling can have a carrier layer made of a metal material such as aluminium or an aluminium alloy, for example approximately 2 mm thick, which receives or carries preformed fragments (so-called structural fragments). Structural fragments are preferably made of a high-density metal material that is as strong as possible, for example a tungsten heavy alloy (WHA). As an alternative or in addition, the fragmentation filling can also be designed for controlled breakdown into fragments (so-called controlled fragments). For example, a metal layer with milled grooves can be provided, which breaks up into a large number of fragments when the active charge is ignited.

According to a development, the warhead casing can be made of a fibre composite material. This not only enables significant weight savings compared to conventional warheads with housings made of steel or titanium; in addition, typical reinforcing fibres decompose in the event of an explosion and thus have no or a negligible fragmenting effect (e.g. carbon fibres burn at the temperatures that typically occur).

The above configurations and developments can be combined with one another as desired, provided that such a combination is reasonable. Further possible configurations, developments and implementations of the invention also comprise combinations, not explicitly mentioned, of features of the invention described above or below with regard to the embodiments. In particular, a person skilled in the art will also add individual aspects as improvements or additions to the basic form of the present invention.

The present invention is explained in more detail below with reference to the embodiments specified in the schematic figures, in which.

Figure 1:
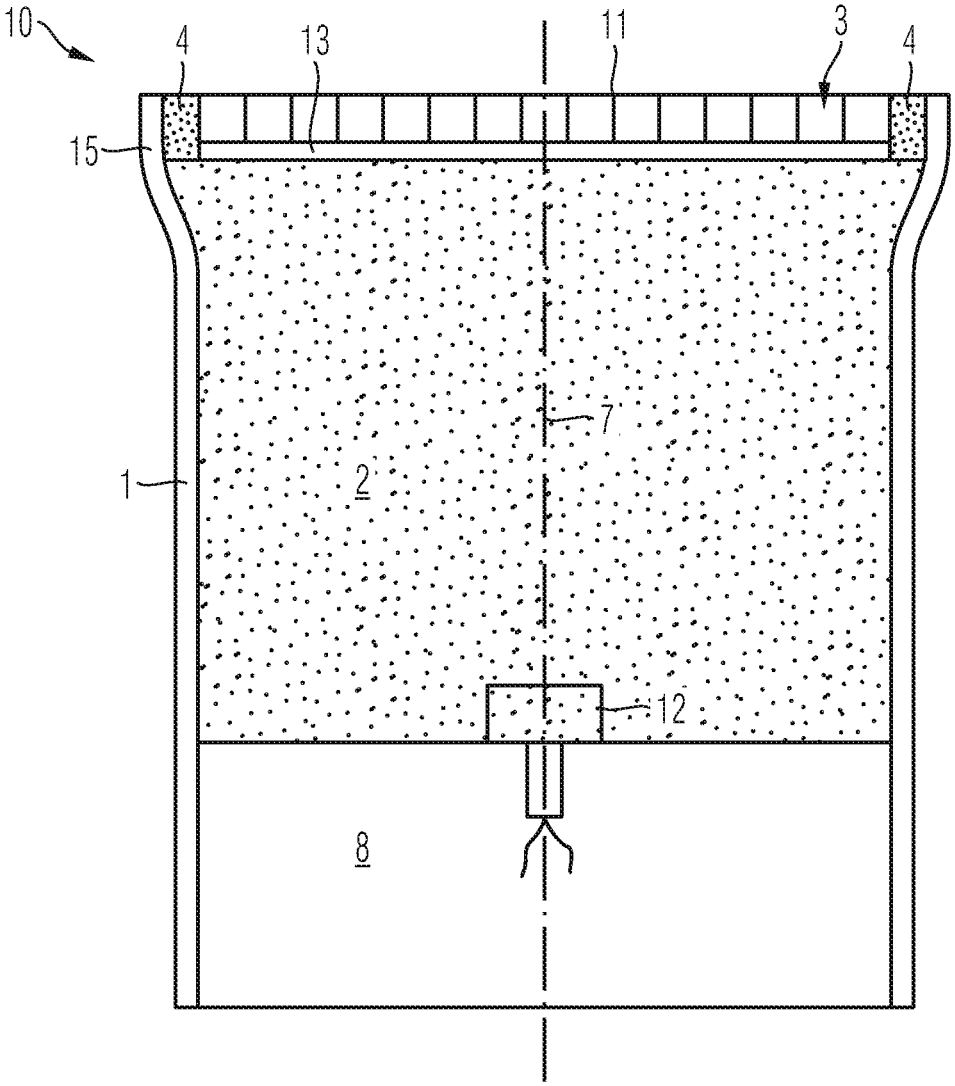
FIG. 1 is a schematic sectional view of a fragmentation warhead according to an embodiment of the invention.

The accompanying figures are intended to provide further understanding of the embodiments of the invention. They illustrate embodiments and, in conjunction with the description, serve to explain principles and concepts of the invention.

Other embodiments and many of the advantages mentioned can be seen in the drawings. The elements of the drawings are not necessarily shown to scale with one another.

In the figures of the drawing, identical, functionally identical and identically acting elements, features and components are each provided with the same reference signs, unless stated otherwise.

Figure 2:
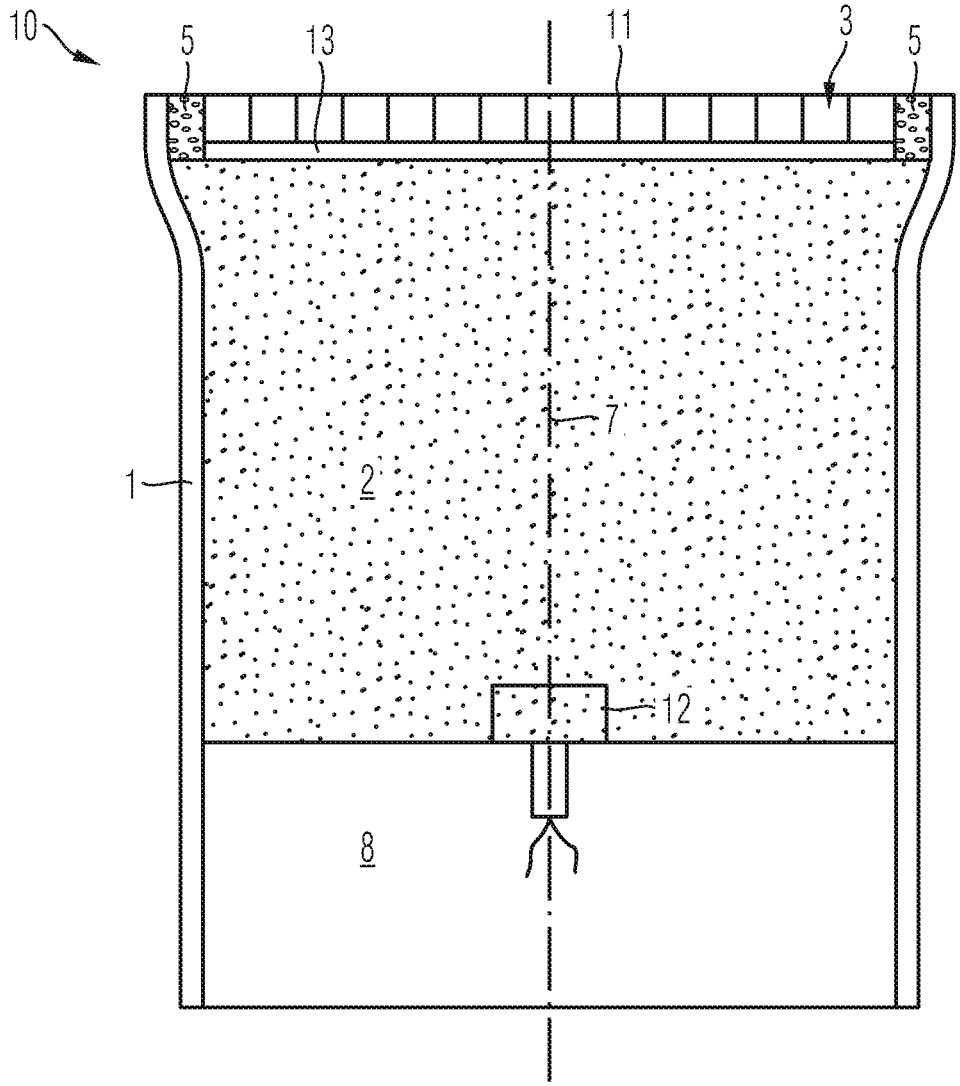
FIG. 2 is a schematic sectional view of a fragmentation warhead according to a further embodiment of the invention.
Figure 3:
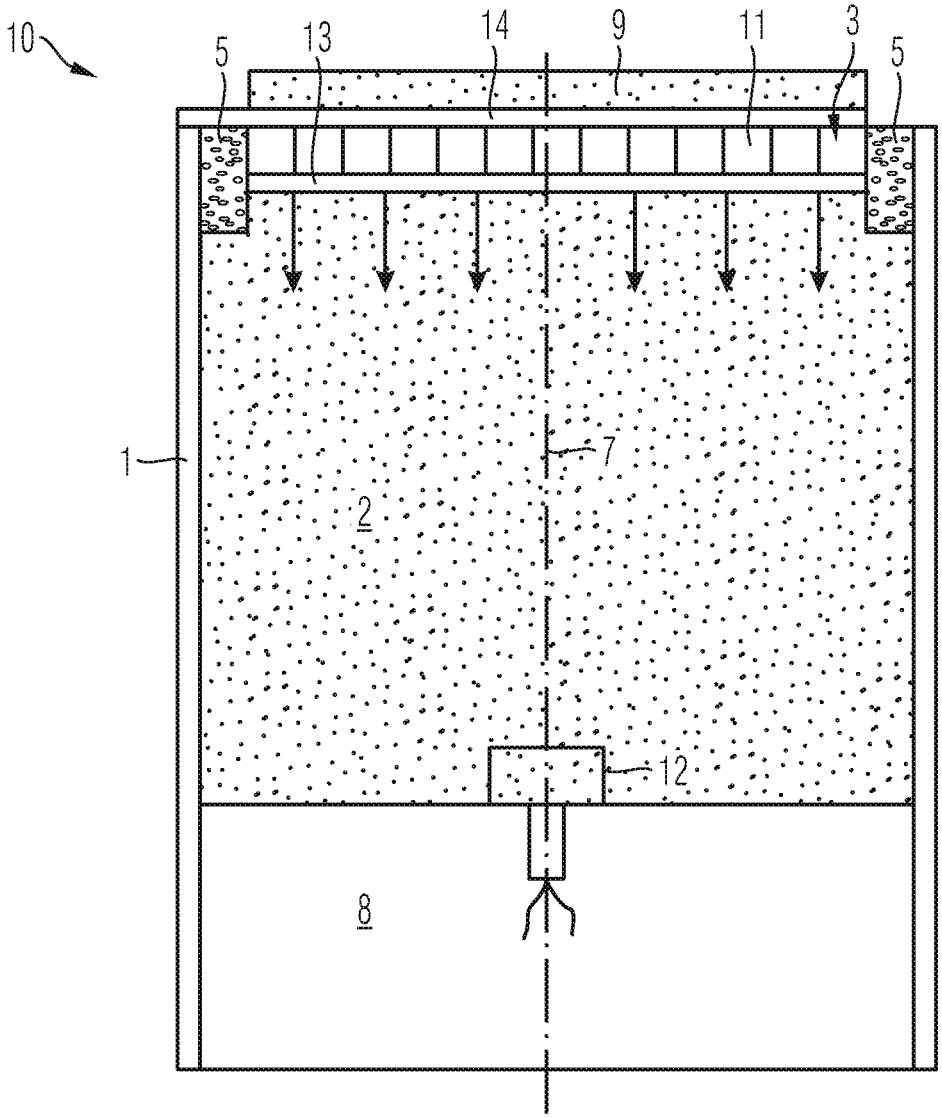
FIG. 3 is a schematic sectional view of a fragmentation warhead according to a further embodiment of the invention.
Figure 4:
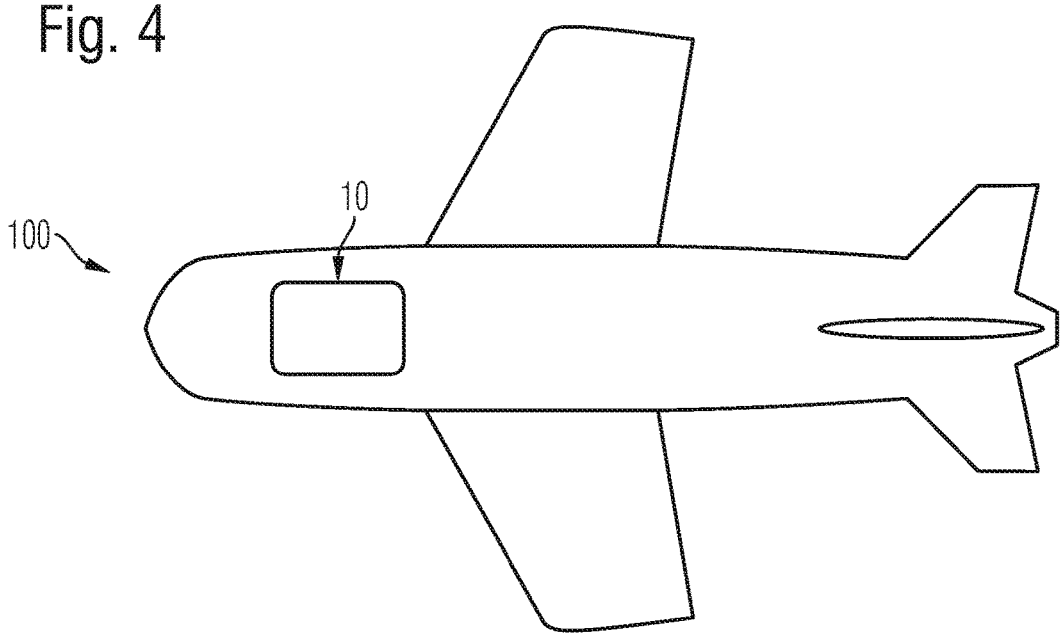
FIG. 4 is a schematic top view of a missile having a fragmentation warhead from FIGS. 1 to 3.

FIGS. 1 to 3 are schematic sectional views of fragmentation warheads 10 according to embodiments of the invention. FIG. 4 also shows a missile 100 having such a fragmentation warhead 10.

The missile 100 can be, for example, a slow-flying missile, for example approx. 100 m/s. For example, the missile 100 can be a guided missile or an unmanned aerial vehicle such as a drone or the like. The target approach of the missile 100 to a target can take place in the final stage on sight (for example electro-optical or infrared).

The fragmentation warheads 10 of FIGS. 1 to 3 are axially symmetrical with respect to an effective direction 7, i.e. their longitudinal axis lies in the effective direction 7. The fragmentation warheads 10 each comprise a warhead casing 1 in which an active charge 2, i.e. a primary charge, is arranged, which can for example consist of a shock-resistant, plastics-bound explosive material. The warhead casing 1 can for example consist of a metal material such as aluminium and/or steel or a corresponding alloy. To avoid unintentional accompanying damage (collateral damage), however, the warhead casing 2 can also be made of composite materials that generate little or no fragments, for example glass fibre reinforced plastic (GFRP) or carbon fibre reinforced plastic (CFRP).

There is also a fragmentation filling 3 in the warhead casing 1, which filling has a carrier layer 13, e.g. plastics material and/or metal layer that is several millimetres thick, by means of which a plurality of preformed fragments 11 made of steel and/or a heavy metal alloy, e.g. tungsten, is carried. The fragmentation filling 3 is arranged within the warhead casing 1 in front of the active charge 2 of the fragmentation warhead 10 in relation to the effective direction 7 of the fragmentation warhead 10. When the active charge 2 is ignited, the fragments 11 are hurled out of the fragmentation filling 3 in the effective direction 7 within an exit opening angle 6*a* (cf. FIG. 5, left-hand side). For example, the first exit opening angle 5*a* can be approximately 60° or cover an angular range of, for example, 55° to 65° degrees, i.e. the fragments 11 are ejected at angles of up to a maximum of 55° to 65° degrees in relation to the effective direction 7. For this purpose, the fragmentation warhead 10 also has a safety and control device 8, which is integrated in a rear portion of the fragmentation warhead 10. The safety and control device 8 is designed, among other things, to detonate the active charge 2 by actuating an ignition 12. For this purpose, the safety and control device 8 can comprise a corresponding time control which controls the ignition 12 accordingly. For this purpose, the ignition 12 can have an ignition chain including a booster and a detonator in the usual manner known to a person skilled in the art.

Figure 6:
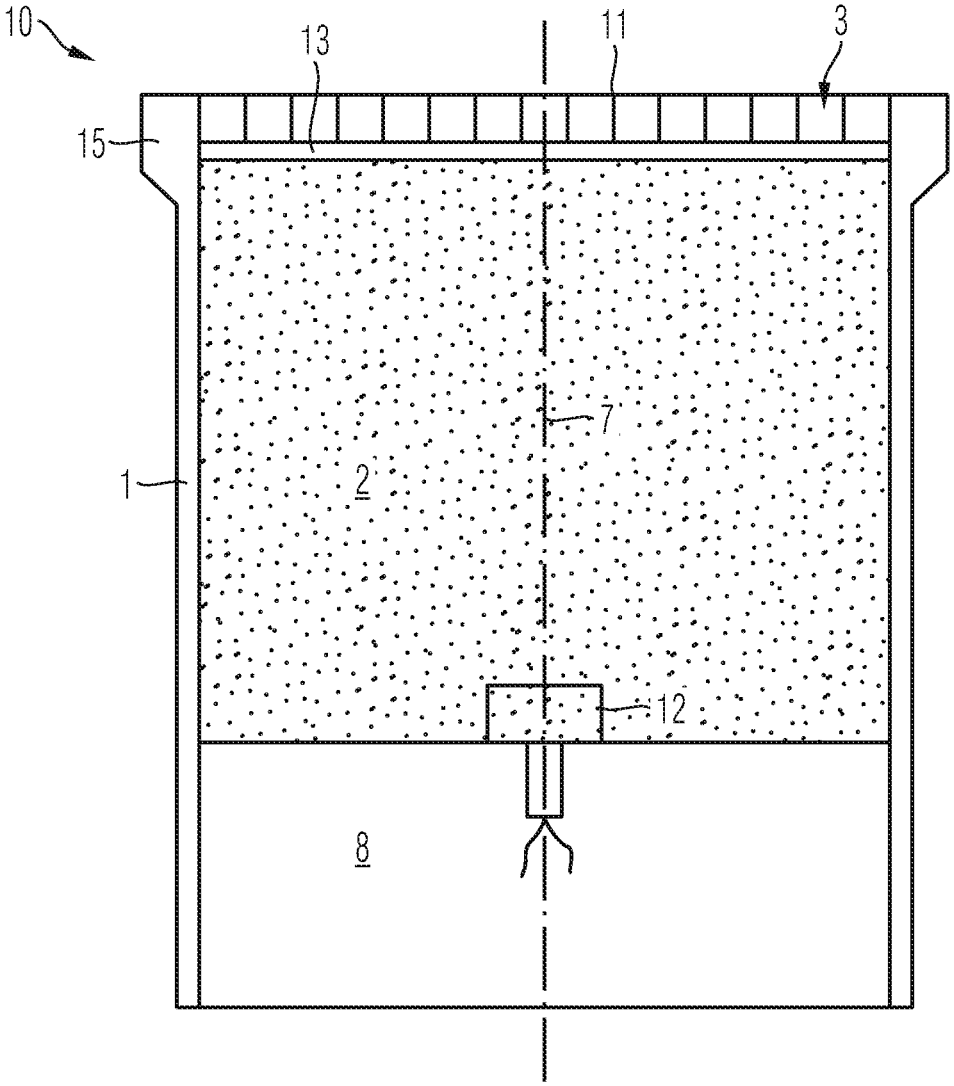
FIG. 6 is a schematic sectional view of a fragmentation warhead according to an example.

The embodiments in FIGS. 1 to 3 pursue different strategies in order to prevent undesired "stray" edge fragments which could possibly emerge laterally at large angles to the effective direction 7 (on this, see further below). In conventional systems, it is sometimes proposed to provide a metal border or the like which is intended to catch or intercept such edge fragments. FIG. 6 shows an example of a fragmentation warhead 10, which also has the basic structure described above. The warhead casing 1 of the fragmentation warhead 10 has a reinforcing, azimuthally extending retaining ring 15, which is intended to assume the task of suppressing large fragments at large exit angles. Said ring is sketched in a "thickened" manner, but can also be of the same calibre, i.e. extending into the interior of the warhead casing 1, it being possible to accordingly design the fragmentation filling 3 with a reduced diameter. In conventional systems of this type, there is now the problem that the retaining ring 15 can also generate edge fragments at large exit angles when the active charge 2 detonates. These are prevented by the present embodiments according to FIGS. 1 to 3, as will be explained below.

For this purpose, the fragmentation warhead 10 in FIG. 1 comprises a fragmentation damping charge 4, which is arranged within the warhead casing 1 laterally to the effective direction 7 on the fragmentation filling 3 and designed to exert a lateral damping pressure on the fragmentation filling 3 upon ignition. For this purpose, the fragmentation damping charge 4 in FIG. 1 is specifically designed as an explosive ring which completely covers the fragmentation filling 3 laterally, i.e. in the radial direction. The safety and control device 8 is now also designed to ignite the fragmentation damping charge 4 in a time-synchronised manner with the active charge 2. Due to the ignition of the fragmentation damping charge 4, a pressure wave arises into the interior of the warhead casing 1, i.e. in the radial direction perpendicularly to the effective direction 7 and thus also perpendicularly to the longitudinal axis of the fragmentation warhead 10. The fragmentation damping charge 4 can be configured in such a way that the resulting lateral pressure due to the detonation of the fragmentation damping charge 4 prevents fragments 11 from expanding laterally at large exit angles. It can thus be ensured that the first exit opening angle 6*a* of the fragmentation warhead 10 remains restricted in accordance with the relevant specifications of the application and that no dangerous edge fragments that may trigger collateral damage are ejected.

As an alternative to this, the fragmentation warheads 10 of FIGS. 2 and 3 comprise a fragmentation damping filling 5, which is designed as a heavy metal powder ring inside the warhead casing 1 laterally to the effective direction 7 around the fragmentation filling 3, the fragmentation damping filling 5 completely covering the fragmentation filling 3 laterally, i.e. in the radial direction. The powder ring is broken up when the active charge 2 is ignited, so that the particles of the heavy metal powder are released laterally from the fragmentation filling 3. Due to the large surface-to-volume ratio of the particles, there is considerable deceleration within the surrounding atmosphere, so that edge fragments that occur are prevented from expanding. In this case, unlike in the embodiment according to FIG. 1, an "inert" variant is provided in order to limit the exit opening angle of the fragments 11 to a predetermined maximum opening angle.

The embodiment according to FIG. 3 also has a deformation charge 9 on the fragmentation filling 3, i.e. the deformation charge 9 is arranged in front of the fragmentation filling 3 in the effective direction 7. The deformation charge 9 can be ignited in advance of the active charge 2 by a corresponding ignition (not shown) via the safety and control device 8. As a result, the fragmentation filling 3 is pressed into the warhead casing in the direction of the active charge 2, whereby the first exit opening angle 6*a* of the fragmentation filling 3 is reduced to a second exit opening angle 6*b* (see arrows pointing downwards in FIG. 3). This is sketched as an example on the right-hand side in FIG. 5. The fragmentation warhead 10 can thus switch between different modes of attack or action very briefly, for example shortly before an attack by the missile 100. A non-focused mode is used here for a targeted attack with a wide dispersion of the fragments (left-hand side in FIG. 5). Alternatively, however, the fragmentation warhead 10 can switch to a focused mode in which the fragments are hurled in a considerably reduced angular range (for example only 15° or 10° to 20° instead of 55° to 65° in the unfocused mode). In order to accommodate this movement of the fragmentation filling 3, the fragmentation damping filling 5 is expanded in this variant in the rearward direction of the fragmentation warhead 10 (see FIG. 3), so that it can still develop its effect even after the deformation charge 9 has detonated.

Figure 5:
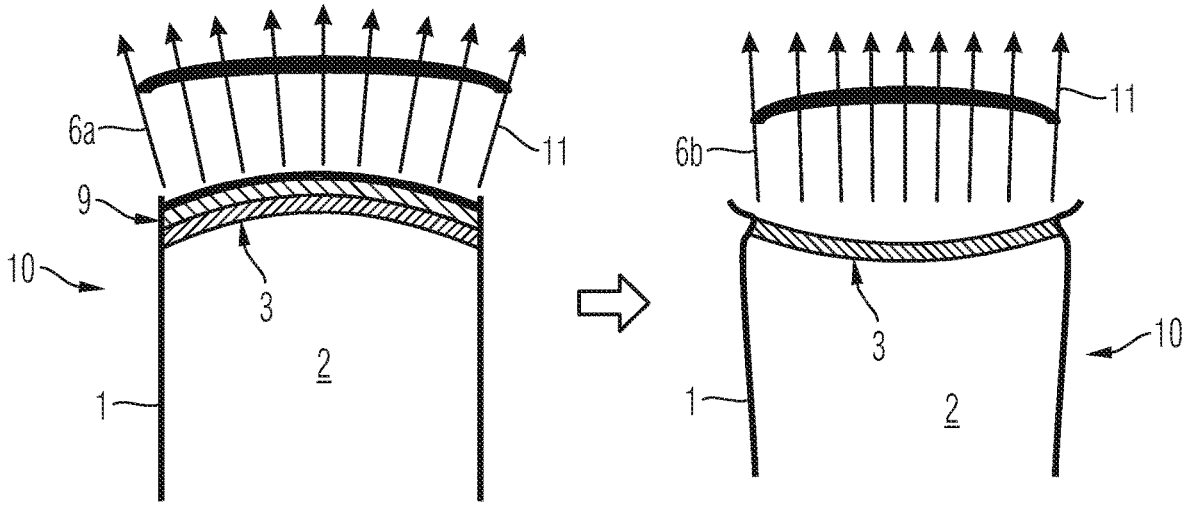
FIG. 5 is a schematic view of the mode of operation of the fragmentation warhead from FIG. 3 before and after deformation.

FIG. 5 schematically indicates the two modes of action of the fragmentation warhead 10 from FIG. 3. On the left-hand side, the fragmentation warhead 10 is in a non-focused mode in which the deformation charge 9 has not (yet) been ignited. The fragmentation filling 3 thus still has its original shape, so that when the active charge 2 is ignited, the fragments 11 emerge up to a maximum of a first exit opening angle 6*a*. On the right-hand side in FIG. 5, the fragmentation warhead 10 is in a focused mode in which the deformation charge 9 has been ignited and the fragmentation filling 3 has been pressed into the warhead casing 1. The fragmentation filling 3 now has an approximately concave shape. As soon as the active charge 2 is ignited, the pressure wave triggered by this accelerates the fragments 11 to the front at angles up to a maximum of the reduced second exit opening angle 6*b*. Stray edge fragments are intercepted (not shown) by the heavy metal powder of the fragmentation damping filling 5, which is also released.

As a result, a flexible active system with increased accuracy is thus provided that can react at short notice to different target encounter requirements.

The embodiments in FIGS. 1 to 3 are merely exemplary in nature and can be modified accordingly by a person skilled in the art. For example, the fragmentation damping charge 4 or fragmentation damping filling 5 are designed as "thickened regions", i.e. the fragmentation warheads 10 are designed to be over-calibrated towards a front end. It will be clear to a person skilled in the art that the fragmentation damping charge 4 or fragmentation damping filling 5 can also have the same calibre, so that a diameter (the calibre) of the fragmentation warhead 10 does not vary in the effective direction 7. In this case, the fragmentation damping charge 4 or fragmentation damping filling 5 extends into the interior of the fragmentation warhead 10, and a diameter of the fragmentation filling 3 has to be adjusted accordingly, i.e. reduced.

In the preceding detailed description, various features have been summarised in one or more examples in order to improve the stringency of the presentation. It should be clear, however, that the above description is merely illustrative and in no way restrictive in nature. It serves to cover all alternatives, modifications, and equivalents of the various features and embodiments. Many other examples will be immediately and directly apparent to a person skilled in the art on the basis of his technical knowledge in view of the above description.

The embodiments were selected and described in order to be able to present the principles on which the invention is based and their possible applications in practice as well as possible. This enables persons skilled in the art to optimally modify and use the invention and its various embodiments with regard to the intended use. In the claims and the description, the terms "including" and "having" are used as neutral terms for the corresponding term "comprising". Furthermore, the use of the terms "a" and "an" should not fundamentally exclude a plurality of features and components described in this way.

LIST OF REFERENCE SIGNS

1 Warhead casing
2 Active charge
3 Fragmentation filling
4 Fragmentation damping charge
5 Fragmentation damping filling
6*a* First exit opening angle
6*b* Second exit opening angle
7 Effective direction
8 Safety and control device
9 Deformation charge
10 Fragmentation warhead
11 Fragments
12 Ignition
13 Carrier layer
14 Damping layer
15 Retaining ring
100 Missile

The invention claimed is:

1. Fragmentation warhead (10) for a missile (100), comprising:

a warhead casing (1);

an active charge (2), which is arranged within the warhead casing (1);

a fragmentation filling (3), which is arranged within the warhead casing (1) in front of the active charge (2) of the fragmentation warhead (10) in an effective direction (7) of the fragmentation warhead (10) and designed such that when the active charge (2) is ignited, fragments (11) are hurled out of the fragmentation filling (3) in the effective direction (7) within a first exit opening angle (6*a*); and a fragmentation damping charge (4), which is arranged within the warhead casing (1) laterally to the effective direction (7) on the fragmentation filling (3) and designed to exert a lateral damping pressure on the fragmentation filling (3) upon ignition.

2. Fragmentation warhead (10) according to claim 1, wherein the fragmentation damping charge (4) is formed in a ring around the fragmentation filling (3).

3. Fragmentation warhead (10) according to claim 1, wherein the fragmentation damping charge (4) completely covers the fragmentation filling (3) laterally.

4. Fragmentation warhead (10) according to claim 1, further comprising:

a safety and control device (8), which is designed to ignite the fragmentation damping charge (4) in a time-synchronised manner with the active charge (2).

5. Fragmentation warhead (10) according to claim 1, further comprising:

a deformation charge (9), which is arranged in front of the fragmentation filling (3) in the effective direction (7) and designed to push the fragmentation filling (3) in the direction of the active charge (2) by ignition, so that the first exit opening angle (6*a*) of the fragmentation filling (3) is reduced to a second exit opening angle (6*b*).

6. Fragmentation warhead (10) according to claim 1, wherein the fragmentation filling (3) is designed for delivering preformed fragments (11) and/or controlled fragments (11).

7. Fragmentation warhead (10) according to claim 1, wherein the warhead casing (1) is made of a fibre composite material.

8. Missile (100) having a fragmentation warhead (10) according to claim 1.

9. Fragmentation warhead (10) for a missile (100), comprising:

a warhead casing (1);

an active charge (2), which is arranged within the warhead casing (1);

a fragmentation filling (3), which is arranged within the warhead casing (1) in front of the active charge (2) of the fragmentation warhead (10) in an effective direction (7) of the fragmentation warhead (10) and designed such that when the active charge (2) is ignited, fragments (11) are hurled out of the fragmentation filling (3) in the effective direction (7) within a first exit opening angle (6*a*); and a fragmentation damping filling (5), which has a metal powder and which is arranged within the warhead casing (1) laterally to the effective direction (7) on the fragmentation filling (3) and designed such that the metal powder is released laterally from the fragmentation filling (3) when the active charge (2) is ignited.

10. Fragmentation warhead (10) according to claim 9, wherein the fragmentation damping filling (5) is formed in a ring around the fragmentation filling (3).

11. Fragmentation warhead (10) according to claim 9, wherein the fragmentation damping filling (5) completely covers the fragmentation filling (3) laterally.

12. Fragmentation warhead (10) according to claim 9, wherein the fragmentation damping filling (5) is divided into several filling containers.

13. Fragmentation warhead (10) according to claim 12, wherein the filling containers are designed as plastics tubes.

14. Fragmentation warhead (10) according to claim 9, wherein the metal powder comprises a heavy metal.

* * * * *